US011164560B2

(12) United States Patent
Clyburn et al.

(10) Patent No.: US 11,164,560 B2
(45) Date of Patent: Nov. 2, 2021

(54) WELL SITE NOISE CONTROL

(71) Applicant: HALLIBURTON ENERGY SERVICES, INC., Houston, TX (US)

(72) Inventors: Andrew Silas Clyburn, Noble, OK (US); Billy Don Coskrey, Duncan, OK (US); Glenn Howard Weightman, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 402 days.

(21) Appl. No.: 16/334,297

(22) PCT Filed: Oct. 11, 2016

(86) PCT No.: PCT/US2016/056401

§ 371 (c)(1),
(2) Date: Mar. 18, 2019

(87) PCT Pub. No.: WO2018/070997

PCT Pub. Date: Apr. 19, 2018

(65) Prior Publication Data

US 2019/0213993 A1 Jul. 11, 2019

(51) Int. Cl.
*F01N 1/18* (2006.01)
*F01N 13/08* (2010.01)
(Continued)

(52) U.S. Cl.
CPC ..... *G10K 11/22* (2013.01); *E21B 41/00* (2013.01); *F01N 1/18* (2013.01); *F01N 13/085* (2013.01)

(58) Field of Classification Search
CPC ..... G10K 11/22; G10K 11/18; G10K 11/16; F01N 1/18; F01N 1/16; F01N 13/085;
(Continued)

(56) References Cited

U.S. PATENT DOCUMENTS 2,421,838 A * 6/1947 Cline ..... F01N 13/085 454/5
3,792,722 A * 2/1974 Harmon ..... F16L 37/02 138/108

(Continued)

FOREIGN PATENT DOCUMENTS

WO 2015147819 A1 10/2015

OTHER PUBLICATIONS

International Search Report and Written Opinion; PCT Application No. PCT/US2016/056401; dated Jun. 12, 2017.

*Primary Examiner* — Edgardo San Martin
(74) *Attorney, Agent, or Firm* — Polsinelli PC

(57) ABSTRACT

A positionable exhaust apparatus with an exhaust outlet having a first bore extending along a length of the exhaust outlet. The first bore having a longitudinal axis extending the length thereof and an exhaust outlet tip coupled to the exhaust outlet. The exhaust outlet tip having a second bore with at least a portion of the second bore substantially aligned with the first bore of the exhaust outlet. An actuator coupled with the exhaust outlet and the exhaust outlet tip with at least a portion of the exhaust outlet tip to rotate the exhaust outlet tip relative to the exhaust outlet. The exhaust outlet tip rotatable three hundred and sixty degrees about the longitudinal axis of the exhaust outlet.

19 Claims, 6 Drawing Sheets

(51) Int. Cl.
*G10K 11/22* (2006.01)
*E21B 41/00* (2006.01)

(58) Field of Classification Search
CPC .. F01N 13/1838; F01N 13/1844; F01N 13/08; F01N 13/082; B60K 13/04
See application file for complete search history.

(56) References Cited

U.S. PATENT DOCUMENTS 3,856,439 A * 12/1974 Moehrbach ..... F04B 39/06 417/312
3,889,772 A * 6/1975 Kelley ..... B60K 13/04 180/311
4,011,849 A * 3/1977 Latham ..... B60K 13/04 123/198 E
4,392,621 A 7/1983 Viets
4,516,657 A * 5/1985 Allard ..... F02B 63/04 181/204
5,323,606 A * 6/1994 Pesyna ..... F02K 1/004 60/232
6,457,551 B1 * 10/2002 Chang ..... F01N 1/003 181/242
7,086,224 B1 * 8/2006 Perry ..... F01N 13/082 446/176
8,132,755 B2 3/2012 Hollimon et al.
8,413,725 B2 4/2013 Wright et al.
8,590,661 B1 * 11/2013 Johnson, Jr. ..... F02B 35/02 180/309
8,651,218 B2 * 2/2014 Okada ..... E02F 9/0866 180/296
8,714,240 B2 5/2014 Bailey et al.
8,931,266 B2 * 1/2015 Uchida ..... F01N 13/1855 60/319
9,018,791 B2 * 4/2015 Guo ..... F03D 3/005 290/55
9,328,588 B2 5/2016 Loveland
2005/0082110 A1 * 4/2005 Golebiowski ..... B08B 15/02 181/204
2006/0151238 A1 * 7/2006 Giordano ..... F01N 13/082 181/227
2007/0181362 A1 * 8/2007 Champney ..... F01N 13/20 181/227
2010/0071899 A1 3/2010 Coquilleau et al.

* cited by examiner

WELL SITE NOISE CONTROL

CROSS-REFERENCE TO RELATED APPLICATIONS

This application is a national stage entry of PCT/US2016/056401 filed Oct. 11, 2016, said application is expressly incorporated herein in its entirety.

FIELD

The present disclosure relates generally to well site noise control. In particular, the subject matter herein generally relates to directional exhaust for well site noise.

BACKGROUND

Well site operations involve numerous pieces of equipment, many of which can generate significant noise emission, thereby potentially disturbing adjacent structures. Well sites can be located near, or adjacent to, homes, businesses or other structures that may find the noise emissions undesirable, thus it may be desirable to direct exhaust noise away from any structure or entity that may find the noise undesirable.

BRIEF DESCRIPTION OF THE DRAWINGS

Implementations of the present technology will now be described, by way of example only, with reference to the attached figures, wherein.

DETAILED DESCRIPTION

Figure 1:
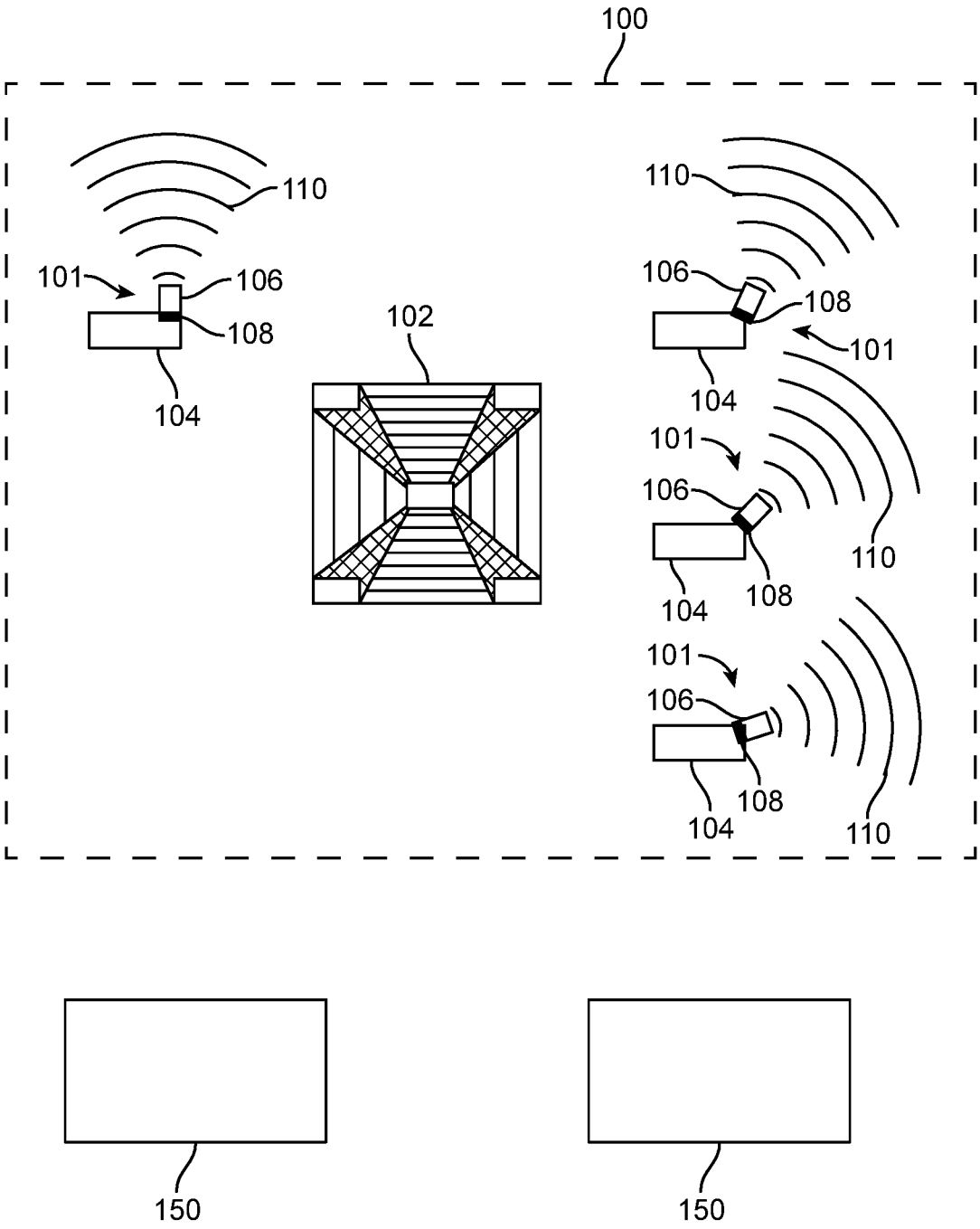
FIG. 1 is a diagrammatic view of a well site with well site noise control apparatus as disclosed herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is directed to a well site noise control apparatus. The well site noise control apparatus can be coupled with equipment at a worksite, such as a wellsite, to release exhaust and direct noise generated by the equipment. The well site noise apparatus may have an exhaust inlet having a longitudinal axis and an exhaust outlet tip coupled with the exhaust inlet. The exhaust outlet tip is rotatable relative to the longitudinal axis of the exhaust inlet. The exhaust outlet tip can have a mouth for releasing exhaust gases received in the exhaust inlet and directing sound produced by the equipment toward a predetermined direction. The exhaust outlet tip and exhaust inlet can each be substantially tubular members each having an inner bore formed therein.

An actuator can be coupled with the exhaust inlet and the exhaust outlet tip to impart a rotation force on the exhaust outlet tip. The actuator can be a mechanical, pneumatic, magnetic, hydraulic, and/or electrical actuator configured to impart rotation to the exhaust outlet tip relative to the exhaust inlet. The exhaust outlet tip can have an elbow forming a second longitudinal axis as it extends to the mouth. In some instances, the second longitudinal axis can be substantially perpendicular to the longitudinal axis. The exhaust outlet tip is rotatable relative to the exhaust inlet, thereby redirecting exhaust noise from propagating about the longitudinal axis to propagating about the second longitudinal axis. The exhaust outlet tip may be rotated three hundred and sixty degrees (360°) about the longitudinal axis, thus allowing rotation of the second longitudinal axis three hundred and sixty degrees (360°). The exhaust outlet tip may be rotated anywhere between greater than zero to 360°.

The well site noise control apparatus can be also implemented within a system including a plurality of well site noise control apparatus coupled with an electronic device configured to optimize the orientation of each individual exhaust inlets minimizing well site noise at a predetermined location, such as an adjacent structure(s). In some instances, the plurality of well site noise control apparatuses can be rotated and pointed to face in directs independently of one another. In some instances, the plurality of well site noise control apparatuses can be pointed in substantially the same direction, such as away from the adjacent structure. In other instances, each of the plurality of well site noise control apparatus can be pointed in different direction to maximize the noise reduction relative to the predetermined location.

The following provides a more detailed discussion of the components herein.

FIG. 1 illustrates an exemplary well site implementing a well site noise control apparatus. A well site 100 can have one or more rigs 102 and one or more pieces of well site equipment 104. The well site equipment 104 can be disposed around the well site 100, including one or more pieces of well site equipment being proximal to the rig 102, or disposed at any other location on the well site 100. The well site equipment 104 can be any support equipment utilized during drilling, casing, fracking, or production operations, and can include pumps, motors, generators, and/or any other known well site equipment 104.

The well site 100 can be defined by the property and/or land encompassing the oil and gas operations, and can include one rig 102, two rigs 102, or any number of rigs 102 disposed about the well site 100. The well site 100 can be adjacent to one or more structures 150 or other predetermined location. The adjacent structures 150 can be homes, business, protected environmental features, or any other structure from where the noise may be undesirable.

The well site equipment 104 can have well site noise control apparatus 101 having an exhaust outlet tip 106 for releasing emissions, exhaust gases, and noise generated during the use of the one or more pieces of well site equipment 104. The exhaust outlet tip 106 can be coupled with a rotational actuator 108 configured to adjust the direction of the exhaust outlet tip 106 and noise 110 generated by the well site equipment 104, thereby reducing the noise profile present at the adjacent structures 150. The rotational actuator 108 can allow a user or operator of the well site 100 to direct noise in a preferred direction, generally away from the adjacent structure 150 or other predetermined location.

As can be appreciated in FIG. 1, the well site 100 has one rig 102 and four pieces of well site equipment 104. The exhaust outlet tip 106 coupled with each well site equipment 104 is directing noise 110 away from the adjacent structures 150. The exhaust outlet tips 106 can be pointed in substantially in different directions, but away from the adjacent structure so as to prevent reverberations off the rig 102, other pieces of well site equipment 104, or similar structures and thus redirecting noise 110 toward the adjacent structures 150.

The well site 100 can utilize a noise control system having one or more rotational actuators 108 coupled, via wire or wireless transmission, with an electronic device configured to minimize noise propagation at one or more predetermined location 150. The electronic device can be a computer, tablet, smartphone, or similar device configured to monitor a noise level at the one or more predetermined locations and adjust the exhaust outlet tip 106 of each individual piece of well site equipment 104 disposed on a well site 100 to minimize the noise signature heard at the one or more predetermined locations 150. The electronic device may adjust the exhaust outlet tips 106 in the same or different directions together or independently of one another. In some instances, the exhaust outlet tips 106 of the well site equipment 104 can propagate noise 110 in substantially the same direction. In other instances, the electronic device can adjust the exhaust outlet tips 106 in different directions to propagate noise 110 away the one or more predetermined locations 150 so as to minimize noise at each location.

While the illustrated embodiment is shown and described with respect to land based operations, this disclosure can be similarly implemented with sea based operations.

Figure 2:
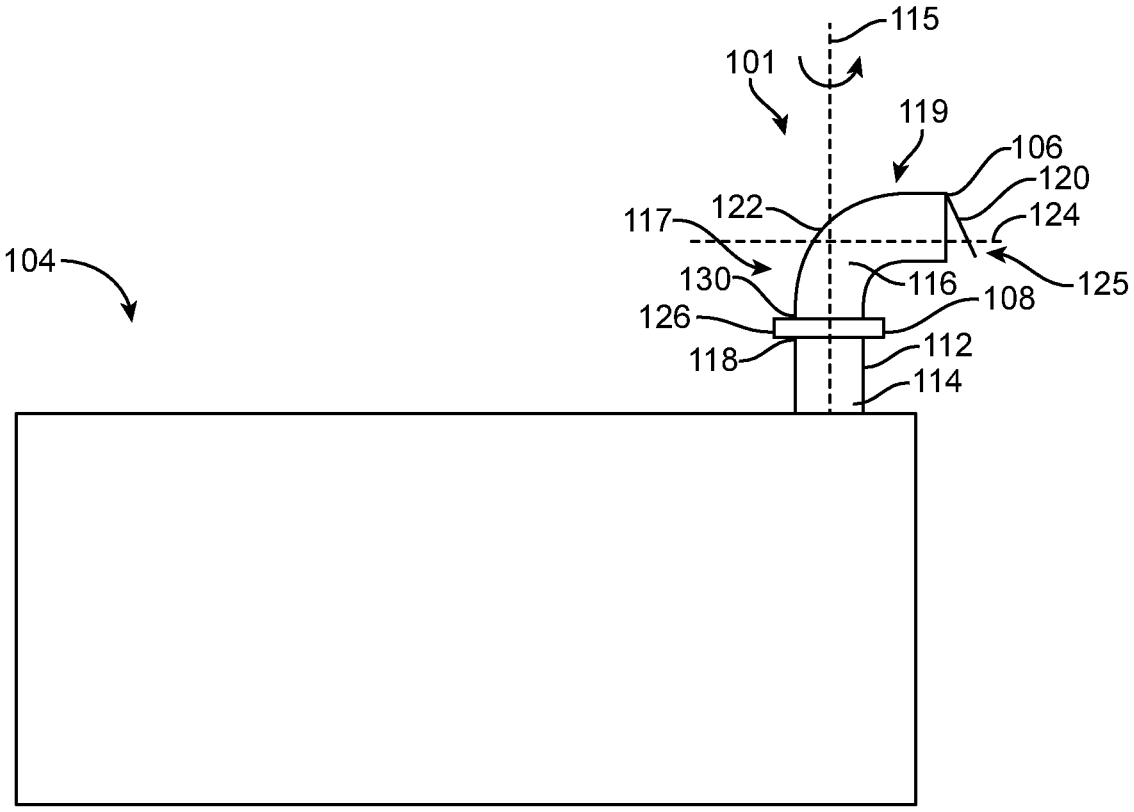
FIG. 2 is a diagrammatic view of an exemplary well site equipment having a noise control apparatus as disclosed herein.

FIG. 2 illustrates an example well site equipment having a well site noise control apparatus 101 extending from the well site equipment 104. The noise control apparatus 101 can have an exhaust outlet tip 106 coupled with a rotational actuator 108. The exhaust outlet tip 106 has a first coupling end 130 for coupling to the rotational actuator 108 and has a second end having a mouth 125. The mouth 125 provides for exiting gaseous exhaust and directing noise produced by the equipment 104. The well site equipment 104 can have an exhaust inlet 112 extending therefrom. The rotational actuator 108 can be coupled with the exhaust inlet 112. The exhaust inlet 112 can be coupled with and be substantially aligned with an initial section of the exhaust outlet tip 106. The rotational actuator 108 can cause rotation of the exhaust outlet tip 106 relative to the exhaust inlet 112.

The exhaust inlet 112 can be a substantially tubular member extending from the well site equipment 104 and having a first inner bore 114 extending the length thereof. The first inner bore 114 has a longitudinal axis 115. The exhaust outlet tip 106 can similarly be a substantially tubular member and have a second inner bore 116 extending the length thereof. A distal end 118 of the exhaust inlet 112 and the coupling end 130 of the exhaust outlet tip 106 can be coupled with the rotational actuator 108 such that at least a section of the first inner bore 114 is substantially aligned with at least a portion of the second inner bore 116. The coupling places the first inner bore 115 in fluid communication with the second inner bore 116 for flow of gaseous exhaust.

The second inner bore 116 may have two axes. The second inner bore 116 may have an initial bore section 117 extending toward the coupling end 130 having a longitudinal axis substantially aligned with the longitudinal axis 115. The second inner bore 116 may then have a second exit bore section 119 extending toward the mouth 125 having a second longitudinal axis 124. Accordingly, due to the change in direction, the mouth 125 may face radially away from the longitudinal axis 115, and therefore face in a direction other than straight up or vertical, and thereby propagate noise and eject exhaust gas in a lateral direction.

In order to provide the change in direction to a second longitudinal axis 124 and propagate the noise radially away from longitudinal axis 115, the exhaust outlet tip 106 can include a bend 122 changing the angle of the second bore 116 relative to the longitudinal axis 115. In some instances, the bend 122 can be a substantially ninety degree (90°) bend in the exhaust outlet tip 106 forming a second longitudinal axis 124 substantially perpendicular to longitudinal axis 115. In other instances, the bend 122 can form a second longitudinal axis 124 at any angle, acute or obtuse, relative to the longitudinal axis 115. For example, the second longitudinal axis 124 can be aligned with the longitudinal axis 115, or can be formed at any angle between about greater than zero degrees (0°) to approximately less than one-hundred eight degrees (180°), including angles of about fifteen degrees (15°), about thirty degrees (30°), about forty five degrees (45°), about sixty degrees (60°), about seventy five degrees (75°), about one hundred five degrees (105°), about one hundred twenty degrees (120°), about one hundred thirty five degrees (135°), one hundred fifty degrees (150°), or about one hundred sixty five degrees (165°).

The exhaust outlet tip 106 can allow exhaust gas and noise 110 to exit the well site equipment 104 via the exhaust inlet 112. The exhaust gas and noise 110 can propagate radially from the exhaust outlet tip 106 through mouth 125, thus allowing the noise control apparatus 108 to control the direction of noise 110 propagation from the well site equipment 104. The exhaust outlet tip may be rotated anywhere between greater than zero to 360°. The exhaust tip may be rotated up to 30°, alternatively up to 60°, alternatively up to 90°, alternatively up to 120°, alternatively up to 150°, or alternatively up to 180°, alternatively up to 210°, alternatively up to 240°, alternatively up to 270°, alternatively up to 300°, alternatively up to 330°, alternatively up to 360°.

The rotational actuator 108 can rotate the exhaust outlet tip 106 three hundred and sixty degrees (360°) about longitudinal axis 115 relative to the exhaust inlet 112 and the well site equipment 104. Rotation of the exhaust outlet tip 106 about the longitudinal axis 114 can vary the direction of the second longitudinal axis 124 and thus the direction of the exhaust outlet tip 106 and mouth 125. Rotation of the exhaust outlet tip 106 allows a user to control the direction of noise 110 propagation from the well site equipment and directing away from adjacent structures 150.

The rotational actuator 108 can be disposed within a housing 126 configured receive at least a portion of the exhaust inlet 112 and at least a portion of the exhaust outlet tip 106. The housing 126 can protect the rotational actuator from the well site environmental conditions. The housing 126 can be of two piece construction providing a user or operator maintenance access to the rotational actuator 108. The housing 126 can be coupled together by fasteners, such as bolts, as can be more clearly appreciated in FIGS. 3-6.

Figure 3:
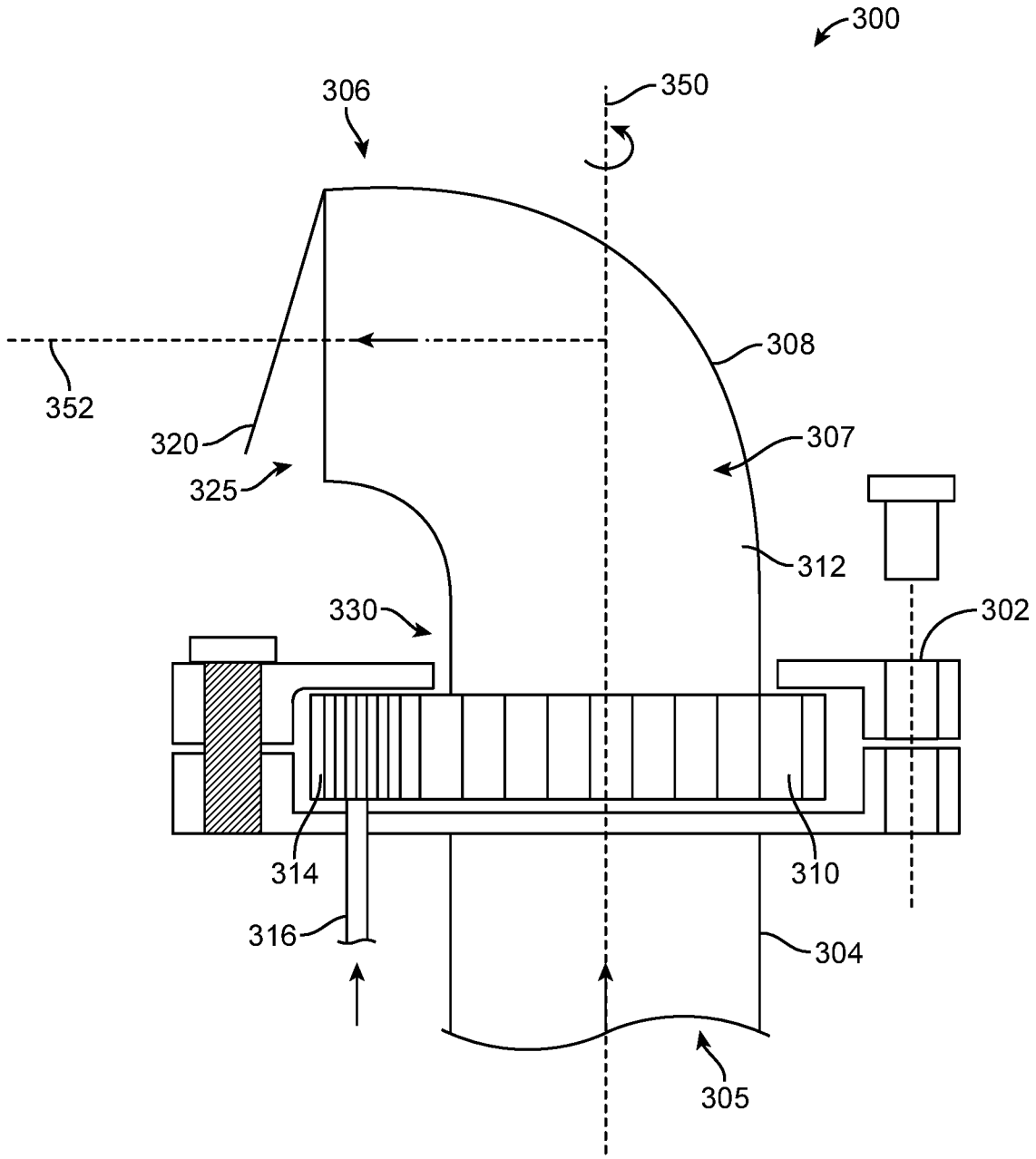
FIG. 3 is a diagrammatic view of an exemplary mechanical gear noise control apparatus as disclosed herein.

FIG. 3 illustrates an exemplary mechanical gear noise control apparatus. The mechanical gear well site noise control apparatus 300 can include a housing 302 coupling an exhaust inlet 304 and an exhaust outlet tip 306. The exhaust inlet 304 can have a first inner bore 305 with longitudinal axis 350 extending therethrough. The exhaust outlet tip 306 can have a second inner bore 307 extending from a first coupling end 330 to the mouth 325. While the inner bore 307 extending toward the first coupling end 330 may have longitudinal axis substantially aligned with the longitudinal axis 350, the exhaust outlet tip 306 can have a bend 308 forming a second longitudinal axis 352 extending toward the mouth 325. The second longitudinal axis 352 can extend substantially perpendicular to the longitudinal axis 350, or can extend at any angle relative to the longitudinal axis 350, including angles of about fifteen degrees (15°), about thirty degrees (30°), about forty five degrees (45°), about sixty degrees (60°), about seventy five degrees (75°), about one hundred five degrees (105°), about one hundred twenty degrees (120°), about one hundred thirty five degrees (135°), one hundred fifty degrees (150°), or about one hundred sixty five degrees (160°). Accordingly, while FIG. 3 illustrates the exhaust outlet tip 306 having a bend 308 formed at approximately ninety degrees (90°), it is within the scope of this disclosure to have a bend 308 formed at any of the aforementioned angles, such as from greater than about zero degrees (0°) to less than about one hundred and eighty degrees (180°) relative to the longitudinal axis 350.

In some instances, the exhaust inlet 304 can have a slightly smaller diameter than the exhaust outlet tip 306, such that at least a portion of the exhaust inlet 304 can be received within the exhaust outlet tip 306. In other instances, at least a portion of the exhaust outlet tip 306 can be received within the exhaust inlet 304, or the exhaust inlet 304 and the exhaust outlet tip 306 can have substantially similar diameters and abutting engaging within the housing 302.

An exhaust gear 310 can be disposed around an outer surface 312 of the exhaust outlet tip 306 and engageable with a positioning gear 314. The positioning gear 314 can be rotationally engaged with the exhaust gear 310 and configured to impart rotational motion onto the exhaust outlet tip 306 about the longitudinal axis 350, thereby altering the orientation of exhaust outlet tip 306 and the second longitudinal axis 352. As can be appreciated in FIG. 3, the exhaust gear 310 and the positioning gear can be a spur gear arrangement. In other instances, the exhaust gear 310 and positioning gear 314 can be a bevel gear, worm gear, hypoid gear, or any other gear arrangement known in the art.

The exhaust gear 310 and positioning gear 314 can each also be friction surfaces engaged with one another to impart rotation of the positioning gear 314. In some instances, the exhaust gear 310 and positioning gear 312 can each engage a portion of a belt coupling the exhaust gear 310 and the positioning gear 314, thereby transferring rotational motion from the positioning gear 314 to the exhaust gear 310.

The positioning gear 312 can have a shaft 316 extending therefrom, the shaft configured to impart rotational motion onto the positioning gear 314. The shaft 316 can be coupled with a motor, handle, or other device configured to impart rotation on the shaft 316. In some instances, the shaft 316 can be coupled with a motor coupled to an electronic device from which a user can control rotation of the shaft 316 thereby controlling the orientation of the exhaust outlet tip 306. In other instances, the shaft 316 can be coupled with a handle configured to allow a user to manual adjust orientation of the exhaust outlet tip 306.

The exhaust outlet tip 306 can further include a cover 320 capable of sealing environmental elements from the exhaust outlet tip 306. The cover 320 can be pivotally coupled with the outer surface 312 of the exhaust outlet tip 306 and pivoted to an open position by exhaust gases flowing through the exhaust outlet tip 306. When exhaust gases are not flowing through the exhaust outlet tip 306, the cover 320 can pivot to a closed position, thereby preventing access to the inner bore of the exhaust outlet tip 306. In some instances, the cover 320 can be biased to the closed position such as by a spring or actuator. In other instances, the cover 320 can be weighted so as to be biased to a closed position.

Figure 4:
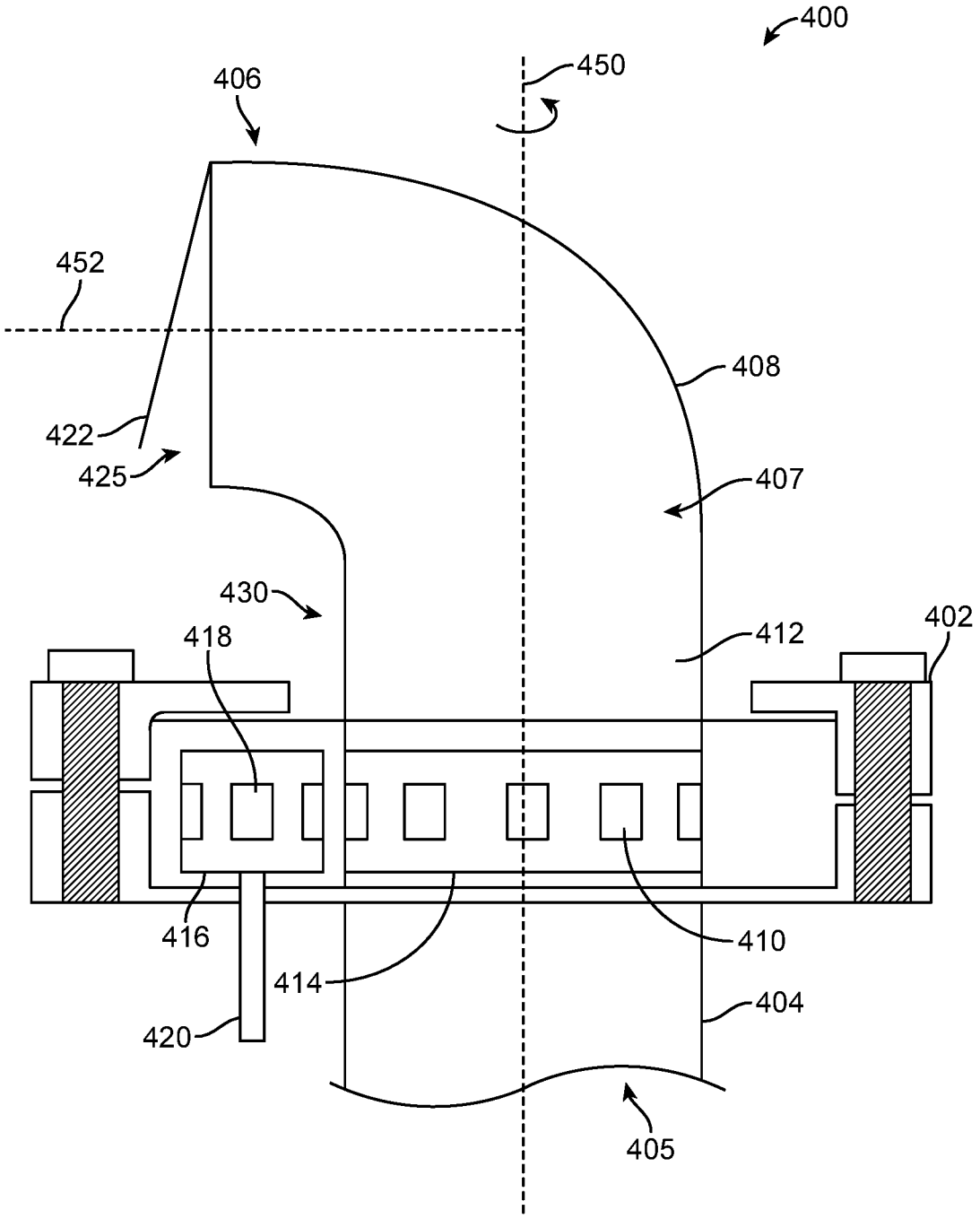
FIG. 4 is a diagrammatic view of an exemplary magnetic noise control apparatus as disclosed herein.

FIG. 4 illustrates an exemplary magnetic noise control apparatus. The magnetic noise control apparatus 400 can include a housing 402 coupling an exhaust inlet 404 and an exhaust outlet tip 406. The exhaust inlet 404 can have a first inner bore 405 with longitudinal axis 450 extending therethrough. The exhaust outlet tip 406 can have a second inner bore 407 extending from a first coupling end 430 to the mouth 425. While the inner bore 407 extending toward the first coupling end 430 may have longitudinal axis substantially aligned with the longitudinal axis 450, the exhaust outlet tip 406 can have a bend 408 forming a second longitudinal axis 452 extending toward the mouth 425. The second longitudinal axis 452 can extend substantially perpendicular to the longitudinal axis 450, or can extend at any angle relative to the longitudinal axis 450. Accordingly, bend 408 may have the same angles as mentioned regarding bends 122 and 308, such as from greater than about zero degrees (0°) to less than about one hundred and eighty degrees (180°) relative to the longitudinal axis 450.

In some instances, the exhaust inlet 404 can have a slightly smaller diameter than the exhaust outlet tip 406, such that at least a portion of the exhaust inlet 404 can be received within the exhaust outlet tip 406. In other instances, at least a portion of the exhaust outlet tip 406 can be received within the exhaust inlet 404, or the exhaust inlet 404 and the exhaust outlet tip 406 can have substantially similar diameters and abutting engaging and aligned along the longitudinal axis 450 within the housing 402.

The exhaust outlet tip 406 can have a plurality of magnetic elements 410 disposed on an outer surface 412. The plurality of magnetic elements 410 can be arranged around a perimeter 414 of the exhaust outlet tip 406 outer surface 412 and be disposed on at least a portion of the exhaust outlet tip 406 received within the housing 402. The housing 402 can also receive a positioning magnetic element 416 having a plurality of corresponding magnetic elements 418 disposed on an outer surface 420 thereof. The magnetic elements 410 and the corresponding magnetic elements 418 can have opposite polarities generating a magnetic attraction therebetween. The positioning magnetic element 418 can be rotated, thereby imparting rotation on the exhaust outlet tip 406 as magnetic elements 410 interact with corresponding magnetic elements 418.

The positioning magnetic element 416 can have a shaft 420 extending therefrom and configured to receive a rotational force onto the positioning magnetic element 416. The shaft 420 can couple with a motor, handle, or other apparatus configured receive the rotational force. In some instances, the shaft 420 can be coupled to a motor coupled with an electronic device. The electronic device can control the orientation of the exhaust outlet tip 406 can one or more signals to the motor to impart a rotational force onto the positioning magnetic element 416, thereby rotating the exhaust outlet tip 406. In some instances, the electronic device can control the orientation of the one or more exhaust outlet tips 406 to maximize noise propagation away from one or more adjacent structures as discussed above with respect to FIG. 1.

The exhaust outlet tip 406 can further include a cover 422 capable of sealing environmental elements from the exhaust outlet tip 406. The cover 422 can be pivotally coupled with the outer surface 412 of the exhaust outlet tip 406 and pivoted to an open position by exhaust gases flowing through the exhaust outlet tip 406. When exhaust gases are not flowing through the exhaust outlet tip 406, the cover 422 can pivot to a closed position, thereby preventing access to the inner bore of the exhaust outlet tip 406. In some instances, the cover 422 can be biased to the closed position such as by a spring or actuator. In other instances, the cover 422 can be weighted so as to be biased to a closed position.

Figure 5A:
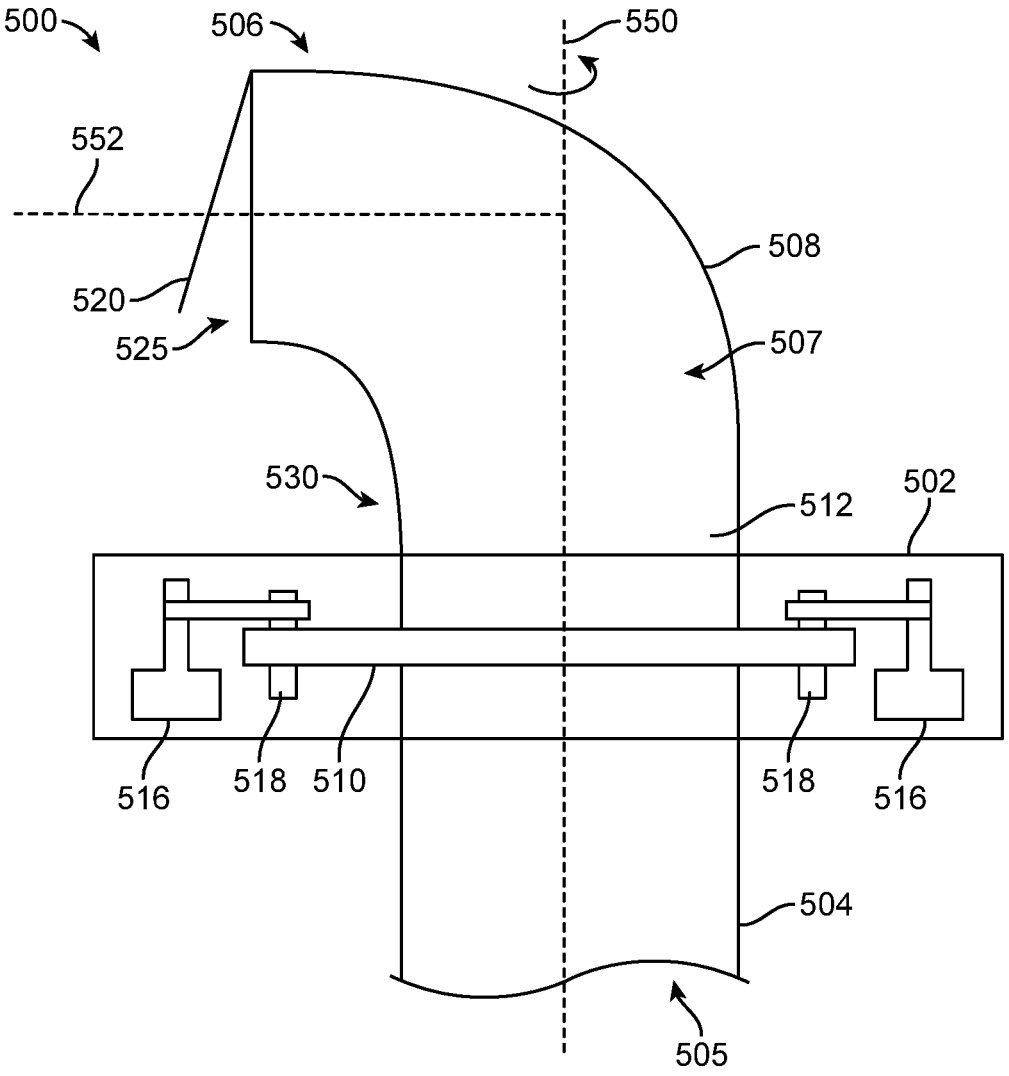
FIG. 5A is a diagrammatic view of an exemplary mechanical pin and plate noise control apparatus as disclosed herein.
Figure 5B:
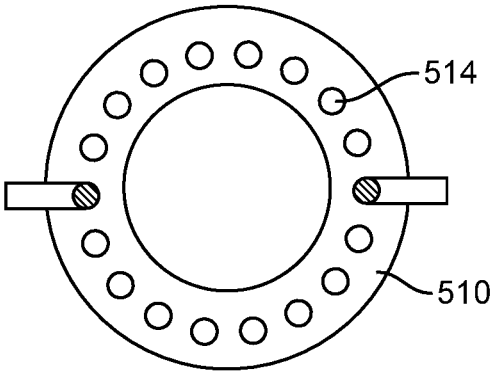
FIG. 5B is a diagrammatic view of an exemplary plate of a pin and plate noise control apparatus as shown in FIG. 5A.

FIGS. 5A and 5B illustrate an example plate and pin well site noise control apparatus. The plate and pin noise control apparatus 500 can include a housing 502 coupling an exhaust inlet 504 and an exhaust outlet tip 506. The exhaust inlet 504 can have a first inner bore 405 with longitudinal axis 550 extending therethrough. The exhaust outlet tip 506 can have a second inner bore 507 extending from a first coupling end 530 to the mouth 525. While the inner bore 507 extending toward the first coupling end 530 may have longitudinal axis substantially aligned with the longitudinal axis 550, the exhaust outlet tip 306 can have a bend 508 forming a second longitudinal axis 552. The second longitudinal axis 552 can extend substantially perpendicular to the longitudinal axis 550, or can extend at any angle relative to the longitudinal axis 550. Accordingly, bend 508 may have the same angles as mentioned regarding bends 122, 308 and 408, such as from greater than about zero degrees (0°) to less than about one hundred and eighty degrees (180°) relative to the longitudinal axis 550.

The housing 502 can receive at least a portion of the exhaust inlet 504 and at least a portion of the exhaust outlet tip 506. The exhaust inlet 504 and the exhaust outlet tip 506 can be coupled one to the other, so as to substantially align along the longitudinal axis 550. A plate 510 can be disposed around an outer surface 512 of the portion of the exhaust outlet tip 502 received within the housing 502. The plate 510 can radially extend from the outer surface 512 of the exhaust outlet tip 506 and have a plurality of apertures 514 formed therein. Each aperture 514 of the plurality of apertures 514 can correspond to a different orientation of the exhaust outlet tip 506 relative to the exhaust inlet 504. The apertures 514 can be arranged at a predetermined radius from the outer surface 512. The housing 502 can further receive one or more displaceable pin arrangements 516 having a pin 518 receivable into at least one aperture 514. The displaceable pin arrangement 516 can dispose the pin 518 through one or more of the plurality of apertures 514, thereby fixing the orientation of the exhaust outlet tip 506 relative to the exhaust inlet 504. The pin 518 can be displaced away from the plate 510 and removed from the aperture 514 allowing rotation of the exhaust outlet tip 506, and the pin 518 can be disposed through another aperture 514, thus securing the exhaust outlet tip 506 at another orientation. The pin 518 can be coupled to a linear actuator, or other motor, to displace the pin into and out of the plurality of apertures 514.

The exhaust outlet tip 506 can further include a cover 520 capable of sealing environmental elements from the exhaust outlet tip 506. The cover 520 can be pivotally coupled with the outer surface 512 of the exhaust outlet tip 506 and pivoted to an open position by exhaust gases flowing through the exhaust outlet tip 506. When exhaust gases are not flowing through the exhaust outlet tip 506, the cover 520 can pivot to a closed position, thereby preventing access to the inner bore of the exhaust outlet tip 506. In some instances, the cover 520 can be biased to the closed position such as by a spring or actuator. In other instances, the cover 520 can be weighted so as to be biased to a closed position.

Figure 6:
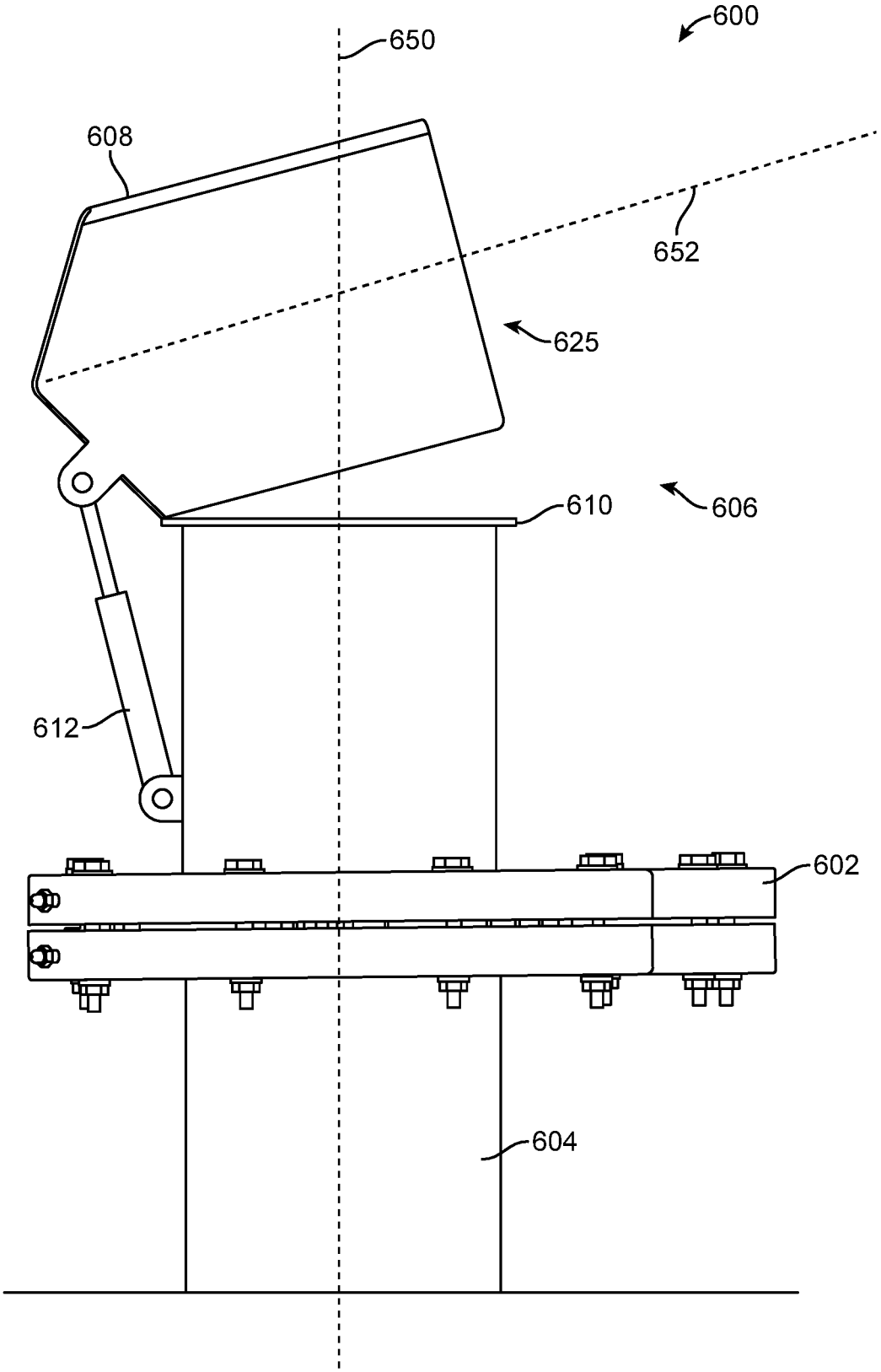
FIG. 6 is a diagrammatic view of an exemplary noise control apparatus having a positionable caps disclosed herein.

FIG. 6 illustrates an example well site noise control apparatus with a positionable cap. The well site noise control apparatus 600 can have a housing 602 receiving a portion of an exhaust inlet 604 and a portion of an exhaust outlet tip 606. The exhaust inlet 604 can have a longitudinal axis 650 extending through the middle thereof and at least a portion of the exhaust outlet tip 606 can align with the longitudinal axis 650. The housing 602 can receive one or more components as discussed above with respect to FIGS. 3-5 configured to allow rotation of the exhaust outlet tip 606 relative to the exhaust inlet 604, thereby rotating the exhaust outlet tip 606 about longitudinal axis 650.

The exhaust outlet tip 606 can have a positionable cover 608 disposed on an end 610 extending away from the exhaust inlet 604. The positionable cover 608 can alter the orientation of the end 610 relative to the exhaust inlet 604, thereby forming a second longitudinal axis 652. The positionable cover 608 can actuate so as to alter orientation of the second longitudinal axis 652 relative to the longitudinal axis 650. In some instances, the positionable cover 608 can vary the orientation of the second longitudinal axis 652 between 0 degrees (substantially perpendicular) and 90 degrees (substantially parallel) relative to the longitudinal axis 650, including angles of about fifteen degrees (15°), about thirty degrees (30°), about forty five degrees (45°), about sixty degrees (60°), or about seventy five degrees (75°).

The positionable cover 608 can provide a second degree of freedom to adjust the orientation of the exhaust outlet tip 606, thereby allowing more precise control of noise propagation from well site equipment.

As can be appreciated in FIG. 6, the positionable cover 608 is pivotally disposed over the end 610 of the exhaust outlet tip 606. The positionable cover 608 is coupled to an actuator 612 such that when the actuator is retracted the second longitudinal axis 652 is substantially perpendicular to the longitudinal axis 650 and as the actuator extends the second longitudinal axis 652 increases in angle relative to the longitudinal axis 650 and can approach substantially parallel. The actuator 612 can be computer controlled to allow remote adjustment and operation of the positionable cover 608.

In some instances, the actuator 612 can be coupled with the positionable cover 608 and the exhaust outlet tip 606. In other instances, the positionable cover 608 can be coupled with the housing 602, or the exhaust inlet 604.

While FIG. 6 illustrates the well site noise control apparatus 600 having an exhaust outlet tip 606 rotatable relative to the exhaust inlet 604, the positionable cover 608 can also be implemented without a housing 602 configured to rotate the exhaust outlet tip 606 about the longitudinal axis 650.

Numerous examples are provided herein to enhance understanding of the present disclosure. A specific set of statements are provided as follows.

Statements:

Statement 1. A well site noise apparatus including an exhaust inlet having a first inner bore for receiving exhaust from a piece of equipment, the first inner bore extending along a length of the exhaust inlet and having a longitudinal axis, and an exhaust outlet tip having a first coupling end coupled with the exhaust inlet and a second end having a mouth for exiting exhaust, a second inner bore extending from the first coupling end to the mouth, the first inner bore and second inner bore being in fluid communication for the passage of exhaust, wherein the exhaust outlet tip is rotatable three hundred and sixty degrees about the longitudinal axis of the exhaust inlet.

Statement 2. A positionable exhaust apparatus of Statement 1, wherein the mouth faces radially outward from the longitudinal axis of the first inner bore.

Statement 3. The positionable exhaust system of Statement 1 or Statement 2, wherein the second inner bore includes a bend between first coupling end and the mouth thereby defining a second longitudinal axis as the second inner bore extends toward the mouth.

Statement 4. A positionable exhaust apparatus according to any one of the preceding Statements 1-3, wherein the second inner bore has an initial bore section extending to the first coupled end and having a longitudinal axis being substantially aligned with the longitudinal axis of the first inner bore, and the second inner bore having an exit bore section extending to the mouth and having a longitudinal axis being at an angle to the longitudinal axis of the first inner bore.

Statement 5. The positionable exhaust system of Statement 4, wherein the longitudinal axis of the exit bore section of the second inner bore is substantially perpendicular to the longitudinal axis of the first inner bore.

Statement 6. The positionable exhaust apparatus according to any one of the preceding Statements 1-5, further including a rotational actuator engaged with at least a portion of the exhaust outlet tip to rotate the exhaust outlet tip relative to the exhaust inlet.

Statement 7. The positionable exhaust apparatus of Statement 6, wherein the rotational actuator couples the exhaust outlet tip to the exhaust inlet.

Statement 8. The positionable exhaust system of Statement 6, wherein the actuator is manually operated to rotate the exhaust outlet tip relative to the exhaust inlet.

Statement 9. The positionable exhaust system of Statement 6, wherein the actuator is electronically controlled to rotate the exhaust outlet tip relative to the exhaust inlet.

Statement 10. The positionable exhaust system of Statement 6, wherein the actuator is remote controlled to rotate the exhaust outlet tip relative to the exhaust inlet.

Statement 11. The positionable exhaust system of Statement 6, wherein the exhaust outlet tip has a gear disposed on an outer surface and the actuator has a corresponding gear arrangement engagable with the exhaust outlet tip gear.

Statement 12. The positionable exhaust system according to any one of the preceding Statements 1-11, wherein the exhaust outlet tip has a plurality of magnets disposed on an outer surface of a first polarity and the actuator has one or more magnets of a second polarity, the first polarity being opposite the second polarity.

Statement 13. The positionable exhaust system according to any one of the preceding Statements 1-12, wherein the exhaust outlet tip has a plate disposed on the outer surface and radially extending away therefrom and having a plurality of holes disposed therein and the actuator has a pin receivable within one of the plurality of holes, wherein the pin being received within one of the plurality of holes prevents rotation of the exhaust outlet tip relative to the exhaust inlet.

Statement 14. A positionable exhaust apparatus including an exhaust outlet tip having a first coupling end and a second end having a mouth for exiting exhaust, the exhaust outlet tip having an inner outlet bore extending from the coupling end to the mouth, a rotational actuator coupled with the first coupling end, the rotational actuator engaged with at least a portion of the exhaust outlet tip to rotate the exhaust outlet tip relative to the exhaust outlet.

Statement 15. A positionable exhaust apparatus of Statement 14, wherein the exhaust outlet tip is rotatable three hundred and sixty degrees about the longitudinal axis of the exhaust outlet.

Statement 16. A noise control system including a plurality of noise control apparatus coupled with two or more equipment pieces disposed about a work site which produce exhaust, each of the noise control apparatuses having an exhaust inlet and an exhaust outlet tip, the exhaust outlet tip having a mouth for releasing exhaust, and a rotational actuator is disposed between each of the exhaust inlets and exhaust outlet tips, the rotational actuators engaged with at least a portion of the exhaust outlet tip to rotate the exhaust outlet tip relative to the exhaust outlet, wherein each noise control apparatuses are independently rotationally actuatable one from another.

Statement 17. The positionable exhaust apparatus of Statement 16, wherein the exhaust outlet tip is rotatable three hundred and sixty degrees relative the exhaust inlet for each of the plurality of noise control apparatus.

Statement 18. A method comprising for controlling noise at an equipment site including providing a plurality of noise control apparatuses on one or more equipment pieces around a work site, each of the plurality of noise control apparatuses having a mouth for ejecting exhaust gases and through which noise generated from the equipment pieces is propagated, measuring a first noise level at a predetermined location during operation of the one or more pieces of equipment, adjusting the direction toward which the mouth of the plurality of noise control apparatuses face to orient noise propagation away from the predetermined location, and measuring a reduced noise level at the predetermined location during operation of the one or more pieces of equipment, wherein the noise control apparatus of the one or more pieces of equipment is adjusted so as to minimize the reduced noise level.

Statement 19. The noise control system of Statement 18, wherein the actuator control device is electronically controlled to rotate the exhaust outlet tip of the two or more pieces of equipment.

Statement 20. The noise control system of Statement 18, wherein the mouth of the plurality of noise control apparatuses is adjustable three hundred and sixty degrees.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A well site noise apparatus comprising:

an exhaust inlet having a first inner bore for receiving exhaust from a piece of equipment, the first inner bore extending along a length of the exhaust inlet and having a longitudinal axis;

an exhaust outlet tip having a first coupling end coupled with the exhaust inlet and a second end having a mouth for exiting exhaust, a second inner bore extending from the first coupling end to the mouth, the first inner bore and second inner bore being in fluid communication for the passage of exhaust, wherein the exhaust outlet tip is rotatable three hundred and sixty degrees about the longitudinal axis of the exhaust inlet; and a rotational actuator engaged with at least a portion of the exhaust outlet tip to rotate the exhaust outlet tip relative to the exhaust inlet, wherein the rotational actuator is coupled with an electronic device operable to monitor a noise level at one or more predetermined locations and adjust the exhaust outlet tip to reduce the noise signature heard at the one or more predetermined locations.

2. The apparatus of claim 1 wherein the mouth faces radially outward from the longitudinal axis of the first inner bore.

3. The system of claim 1, wherein the second inner bore includes a bend between first coupling end and the mouth thereby defining a second longitudinal axis as the second inner bore extends toward the mouth.

4. The apparatus of claim 1 wherein the second inner bore has an initial bore section extending to the first coupled end and having a longitudinal axis being substantially aligned with the longitudinal axis of the first inner bore, and the second inner bore having an exit bore section extending to the mouth and having a longitudinal axis being at an angle to the longitudinal axis of the first inner bore.

5. The system of claim 2, wherein the longitudinal axis of the exit bore section of the second inner bore is substantially perpendicular to the longitudinal axis of the first inner bore.

6. The apparatus of claim 1, wherein the rotational actuator couples the exhaust outlet tip to the exhaust inlet.

7. The system of claim 1, wherein the actuator is manually operated to rotate the exhaust outlet tip relative to the exhaust inlet.

8. The system of claim 1, wherein the actuator is electronically controlled to rotate the exhaust outlet tip relative to the exhaust inlet.

9. The system of claim 1, wherein the actuator is remote controlled to rotate the exhaust outlet tip relative to the exhaust inlet.

10. The system of claim 1, wherein the exhaust outlet tip has a gear disposed on an outer surface and the actuator has a corresponding gear arrangement engagable with the exhaust outlet tip gear.

11. The system of claim 1, wherein the exhaust outlet tip has a plurality of magnets disposed on an outer surface of a first polarity and the actuator has one or more magnets of a second polarity, the first polarity being opposite the second polarity.

12. The system of claim 1, wherein the exhaust outlet tip has a plate disposed on the outer surface and radially extending away therefrom and having a plurality of holes disposed therein and the actuator has a pin receivable within one of the plurality of holes, wherein the pin being received within one of the plurality of holes prevents rotation of the exhaust outlet tip relative to the exhaust inlet.

13. A positionable exhaust apparatus comprising:

an exhaust outlet tip having a first coupling end and a second end having a mouth for exiting exhaust, the exhaust outlet tip having an inner outlet bore extending from the coupling end to the mouth, a rotational actuator coupled with the first coupling end, the rotational actuator engaged with at least a portion of the exhaust outlet tip to rotate the exhaust outlet tip relative to the exhaust outlet, wherein the rotational actuator is coupled with an electronic device operable to monitor a noise level at one or more predetermined locations and adjust the exhaust outlet tip to reduce the noise signature heard at the one or more predetermined locations.

14. The positionable exhaust apparatus of claim 13 comprising wherein the exhaust outlet tip is rotatable three hundred and sixty degrees about the longitudinal axis of the exhaust outlet.

15. A noise control system comprising:

a plurality of noise control apparatus coupled with two or more equipment pieces disposed about a work site which produce exhaust, each of the noise control apparatuses having an exhaust inlet and an exhaust outlet tip, the exhaust outlet tip having a mouth for releasing exhaust; and a rotational actuator is disposed between each of the exhaust inlets and exhaust outlet tips, the rotational actuators engaged with at least a portion of the exhaust outlet tip to rotate the exhaust outlet tip relative to the exhaust outlet, wherein the rotational actuator is coupled with an electronic device operable to monitor a noise level at one or more predetermined locations and adjust the exhaust outlet tip to reduce the noise signature heard at the one or more predetermined locations, wherein each noise control apparatuses are independently rotationally actuatable one from another.

16. The system of claim 15 comprising wherein the exhaust outlet tip is rotatable three hundred and sixty degrees relative the exhaust inlet for each of the plurality of noise control apparatus.

17. A method comprising for controlling noise at an equipment site comprising:

providing a plurality of noise control apparatuses on one or more equipment pieces around a work site, each of the plurality of noise control apparatuses having a mouth for ejecting exhaust gases and through which noise generated from the equipment pieces is propagated;

monitoring a first noise level at a predetermined location during operation of the one or more pieces of equipment;

adjusting the direction toward which the mouth of the plurality of noise control apparatuses face to orient noise propagation away from the predetermined location;

measuring a reduced noise level at the predetermined location during operation of the one or more pieces of equipment;

wherein the noise control apparatus of the one or more pieces of equipment is adjusted so as to minimize the reduced noise level.

18. The method of claim 17, wherein an actuator control device is electronically controlled to rotate the exhaust outlet tip of the two or more pieces of equipment.

19. The method of claim 17, wherein the mouth of the plurality of noise control apparatuses is adjustable three hundred and sixty degrees.

* * * * *